US011592239B2

(12) United States Patent
O' Coin et al.

(10) Patent No.: US 11,592,239 B2
(45) Date of Patent: Feb. 28, 2023

(54) FLOW DISTRIBUTOR FOR HEAT TRANSFER PLATE

(71) Applicant: Hamilton Sundstrand Space Systems International, Inc., Windsor Locks, CT (US)

(72) Inventors: James R. O' Coin, Somers, CT (US); Mark A. Zaffetti, Suffield, CT (US); Thomas E. Banach, Barkhamsted, CT (US); Dale T. Cooke, West Suffield, CT (US); Jeremy M. Strange, Windsor, CT (US)

(73) Assignee: Hamilton Sundstrand Space Systems International, Inc., Windsor Locks, CT (US)

( * ) Notice: Subject to any disclaimer, the term of this patent is extended or adjusted under 35 U.S.C. 154(b) by 0 days.

(21) Appl. No.: 17/186,643

(22) Filed: Feb. 26, 2021

(65) Prior Publication Data

US 2021/0180872 A1 Jun. 17, 2021

Related U.S. Application Data

(63) Continuation of application No. 14/338,212, filed on Jul. 22, 2014, now abandoned.

(51) Int. Cl.
*F28D 15/02* (2006.01)
*F28D 9/00* (2006.01)
(Continued)

(52) U.S. Cl.
CPC ..... *F28D 15/02* (2013.01); *F25B 39/028* (2013.01); *F28D 9/005* (2013.01); *F28F 9/0273* (2013.01); *F28F 9/0278* (2013.01)

(58) Field of Classification Search
CPC ..... F28F 9/026; F28F 9/0278; F28F 9/027; F28F 9/0273; F28F 9/0282; F28F 9/24;
(Continued)

(56) References Cited

U.S. PATENT DOCUMENTS 3,563,055 A 2/1971 Owens
4,513,587 A * 4/1985 Humpolik ..... F25B 39/02 62/515
(Continued)

FOREIGN PATENT DOCUMENTS

DE 202008004582 U1 6/2008
EP 2806244 A1 11/2014
(Continued)

OTHER PUBLICATIONS

Extended European Search Report Application No. 15176974.2-1602 dated Nov. 16, 2015.
(Continued)

*Primary Examiner* — Harry E Arant
(74) *Attorney, Agent, or Firm* — Locke Lord LLP; Daniel J. Fiorello; Gabrielle L. Gelozin

(57) ABSTRACT

A flow distributor for a heat transfer device having a plurality of channels includes a sheath defining a plurality of distributor holes, each distributor hole configured to be in fluid communication with a respective channel inlet of each channel of the heat transfer device and an insert defining a plurality of fluid channels therein and a fluid inlet, each fluid channel in fluid communication with the fluid inlet. The insert is disposed within the sheath to seal the fluid channels with each fluid channel in fluid communication with a respective one of the distribution holes. The fluid inlet includes an inner inlet and an outer inlet radially outward from the inner inlet for mixing a fluid flow in the fluid inlet for evenly distributing fluid flow (e.g., a two phase flow) into
(Continued)

the fluid channels of the insert and into each channel of the heat transfer device.

16 Claims, 4 Drawing Sheets

(51) Int. Cl.
*F25B 39/02* (2006.01)
*F28F 9/02* (2006.01)

(58) Field of Classification Search
CPC ..... F25B 39/028; F25B 39/02; F25B 39/00; F28D 15/02; F28D 9/005; F28D 9/00
See application file for complete search history.

(56) References Cited

U.S. PATENT DOCUMENTS

| | | | | |
|---|---|---|---|---|
| 4,524,823 | A | 6/1985 | Hummel et al. | |
| 5,651,268 | A | 7/1997 | Aikawa et al. | |
| 2005/0028553 | A1 | 2/2005 | Grau et al. | |
| 2007/0039724 | A1* | 2/2007 | Trumbower ..... | F28F 9/0273 62/515 |
| 2015/0096631 | A1* | 4/2015 | Regan ..... | F16L 41/023 285/120.1 |

FOREIGN PATENT DOCUMENTS

| | | | | |
|---|---|---|---|---|
| JP | S58-11395 | A | | 1/1983 |
| JP | S61-189160 | U | | 11/1986 |
| JP | 2012042121 | A | * | 3/2012 |
| WO | 2007068481 | A1 | | 6/2007 |
| WO | 2014143951 | A2 | | 9/2014 |

OTHER PUBLICATIONS

Notice of Reasons for Rejection, of the Japanese Patent Office, dated Nov. 13, 2018, issued in Corresponding Japanese Patent Application No. JP2015-130890.

* cited by examiner

FLOW DISTRIBUTOR FOR HEAT TRANSFER PLATE

CROSS-REFERENCE TO RELATED APPLICATIONS

This application is a continuation of U.S. patent application Ser. No. 14/338,212, filed, Jul. 22, 2014, the entire contents of which is incorporated herein in its entirety.

BACKGROUND

1. Field

The present disclosure relates to heat transfer systems, and more particularly to heat transferring structures and plates.

2. Description of Related Art

Electrical components in circuitry (e.g., aircraft or spacecraft circuits) require sufficient heat transfer away from the components and/or the system in order to continue to function. Many mechanisms have been used in to accomplish such a task, e.g., fans, heat transfer plates, actively cooled devices such as tubes or plates including tubes therein for passing coolant over a hot surface. While circuitry continues to shrink in size, developing heat transfer devices sufficient to move heat away from the components is becoming increasingly difficult.

Certain heat transfer devices include multiple layers of passages for refrigerant to pass therethrough, all connected to a single inlet. Due to co-existence of multiple states (e.g., liquid and gas) of the refrigerant, the fluid enters into the different layers unevenly, causing uneven thermal distribution and thermal acceptance of each layer. This has presented a limitation on heat transfer that has traditionally had to be taken into account in designing for satisfactory thermal performance.

Such conventional methods and systems have generally been considered satisfactory for their intended purpose. However, there is still a need in the art for improved heat transfer devices. The present disclosure provides a solution for this need.

SUMMARY

In at least one aspect of this disclosure, a flow distributor for a heat transfer device having a plurality of channels includes a sheath defining a plurality of distributor holes, each distributor hole configured to be in fluid communication with a respective channel inlet of each channel of the heat transfer device and an insert defining a plurality of fluid channels therein and a fluid inlet, each fluid channel in fluid communication with the fluid inlet. The insert is disposed within the sheath to seal the fluid channels with each fluid channel in fluid communication with a respective one of the distribution holes. The fluid inlet includes an inner inlet and an outer inlet radially outward from the inner inlet for mixing a fluid flow (e.g., a two-phase flow) in the fluid inlet for evenly distributing the two phase flow into the fluid channels of the insert and into each channel of the heat transfer device.

The sheath and the insert can be integral with one another. The channels can be machined channels between the fluid inlet and the distributor holes. In some embodiments, the insert can be interference fit (e.g., friction fit) into the sheath.

It is also contemplated that the insert and the sheath can be manufactured as a single piece formed together using additive manufacturing or any other suitable method (e.g., lost wax casting).

The channels can be fluidly isolated from each other. The fluid channels can also be spaced apart circumferentially to balance the pressure drop therein. In certain embodiments, each fluid channel can be defined to have equal total length from the fluid inlet to the distributor holes.

The outer inlet can include radial ports that allow flow to join with the inner inlet at an inlet divider, the inlet further defining a fluid channel port for each fluid channel in the insert to allow for the fluid to flow from the inlet around the divider and into each fluid channel.

The inlet can further define a throat, wherein the inner inlet and the outer inlet meet at the throat such that the throat allows flow from the outer inlet and the inner inlet to converge and mix above the divider. The outer inlet can define a plurality of radial ports 106 leading to the throat and each outer inlet hole can align with each of the channels of the insert.

In another aspect of this disclosure, a method for flowing coolant into a heat transfer device includes the steps of forming a flow distributor for a heat transfer device having a plurality of channels, the flow distributor device comprising a body defining a plurality of distributor holes, each distributor hole configured to be in fluid communication with a respective channel inlet of each channel of the heat transfer device, wherein the body defines a plurality of fluid channels therein and a fluid inlet, each fluid channel in fluid communication with the fluid inlet, wherein each fluid channel is in fluid communication with a respective one of the distribution holes, wherein the fluid inlet includes an inner inlet and an outer inlet radially outward from the inner inlet for mixing a two phase flow in the fluid inlet for evenly distributing the two phase flow into the fluid channels defined in the body and into each channel of the heat transfer device. Forming can be done in any suitable manner including additive manufacturing or any other suitable method (e.g., lost wax casting).

In an aspect of this disclosure, a flow director for fluid includes a cylindrical flow body extending along a body axis, the body having internal and external body walls, and a plurality of outlets along the axis extending radially through said walls, a cylindrical sheath coaxial with the flow body, the sheath having a sheath body defined by internal and external sheath walls and a plurality of passages extending axially along the external wall, wherein the external sheath wall is adjacent the internal flow body wall, and each passage in the sheath wall is in fluid communication with a respective outlet in the flow body wall, and a flow director inlet configured to deliver fluid to each passage in the sheath wall. The sheath wall can include a first and second passage, and the axial length of the first passage is greater than the axial length of the second passage.

These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1B:
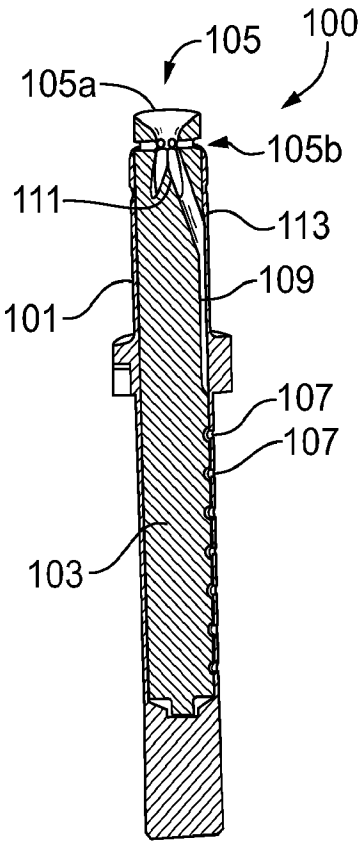
FIG. 1B is a cross-sectional view of the flow distributor of FIG. 1A.
Figure 1A:
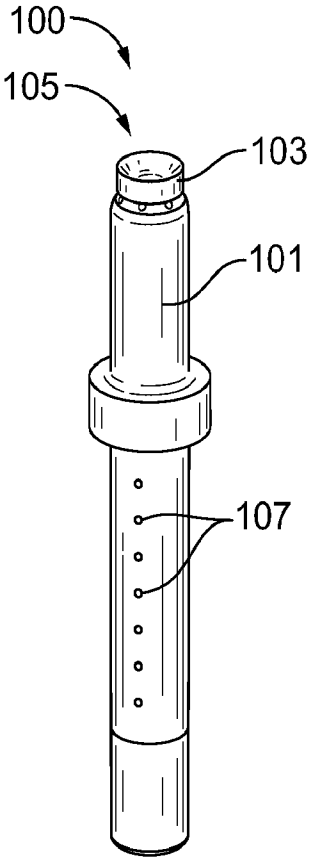
FIG. 1A is a perspective view of an embodiment of a flow distributor in accordance with this disclosure.

Reference will now be made to the drawings wherein like reference numerals identify similar structural features or aspects of the subject disclosure. For purposes of explanation and illustration, and not limitation, a perspective view of an embodiment of the flow distributor in accordance with the disclosure is shown in FIGS. 1A and 1B and is designated generally by reference character 100. Other views of the flow distributor of FIGS. 1A and 1B, and aspects thereof, are shown in FIGS. 2-9. The systems and methods described herein can be used to evenly distribute multiphase fluid flow to a heat transfer device having multiple channels.

Figure 2:
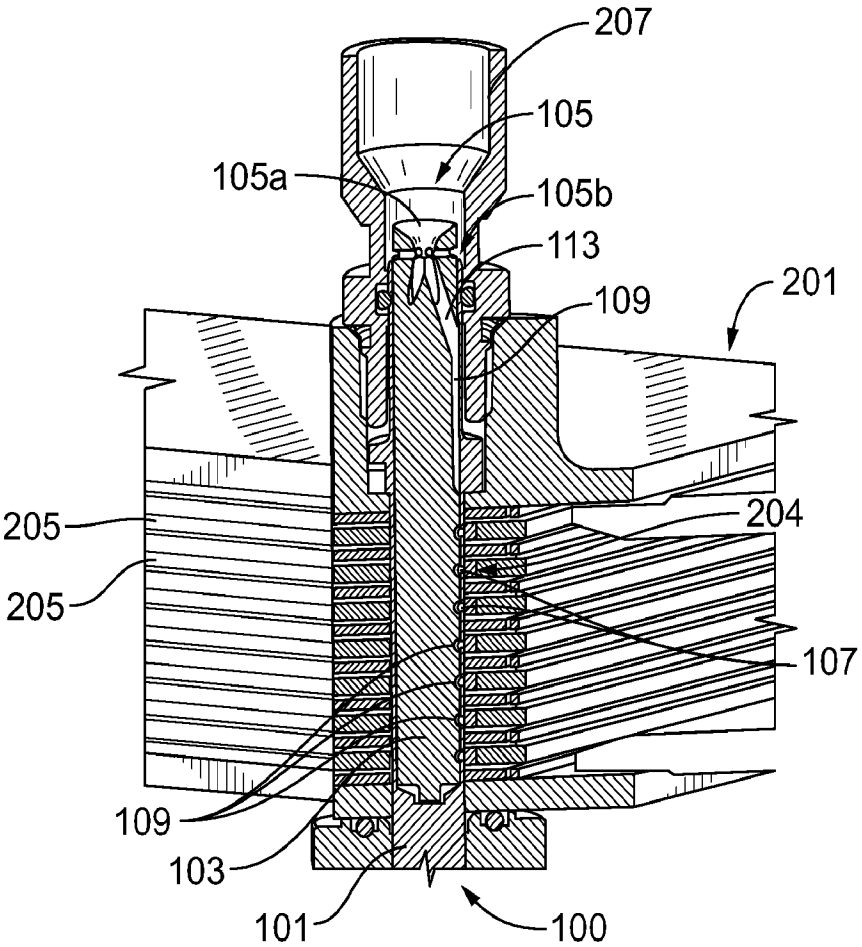
FIG. 2 is a cross-sectional view of the flow distributor of FIG. 1A, shown disposed in a multichannel heat transfer device.

Referring generally to FIGS. 1A, 1B, and 2, a flow distributor 100 for a heat transfer device (e.g., device 201 shown in FIG. 2) includes a sheath 101 defining a plurality of distributor holes 107. As shown in FIG. 2, each distributor hole 107 is configured to be in fluid communication with a respective channel inlet 204 of each channel 205 of the heat transfer device 201.

The flow distributor 100 includes an insert 103 defining a plurality of fluid channels 109 therein and a fluid inlet 105. Each fluid channel 109 is in fluid communication with the fluid inlet 105. Referring additionally to FIGS. 3-7, the insert 103 is disposed within the sheath 101, and in combination with the inner surface of the sheath 101 (as discussed in more detail below) to seal the fluid channels 109 from one another within sheath 101, with each fluid channel 109 in fluid communication with a respective one of the distribution holes 107.

Figure 5:
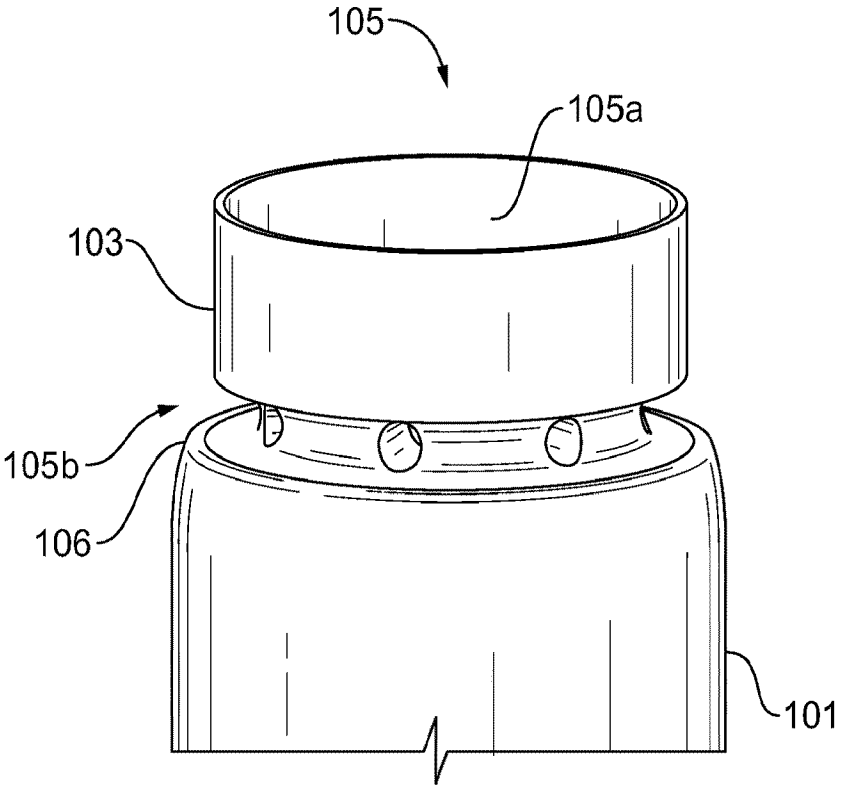
FIG. 5 is a perspective view of the inlet portion of the flow distributor of FIG. 1A, showing an embodiment of the outer inlet.

As also shown in FIG. 5, the fluid inlet 105 includes an inner inlet 105*a* and an outer inlet 105*b* which is radially outward from the inner inlet 105*a*. This allows a two-phase flow (as described in more detail, below) to be mixed in the fluid inlet 105 for evenly distributing the two phase flow into the fluid channels 109 and, thereby providing each channel 205 of the heat transfer device 201 with a mixed two-phase flow. The inlet 105 can include a smaller outer diameter than the portion of the insert defining the channels 109 of the insert 103 such that flow can travel around the inlet 105 to the outer inlet 105*b* when the insert 103 is inserted into sheath 101 and placed within a heat transfer device 201. Any other suitable design to allow fluid to flow to the outer inlet 105*b* is contemplated herein, e.g., channels defined through an outer portion of the inlet 105).

In some embodiments, the sheath 101 and the insert 103 can be integral with one another such that they are fused together and/or formed as one piece in any suitable manner. In other embodiments, the channels 109 can be machined channels between the fluid inlet 105 and the distributor holes 107.

In some embodiments, the insert 103 is interference fit (e.g., friction fit) into the sheath 101. Any other suitable fit or attachment is contemplated herein such that the sheath 101 and insert 103 are constructed and arranged to insure all of the fluid flows into the holes 107, and that there are no fluid leaks between the insert 103 and the sheath 101.

Figure 4:
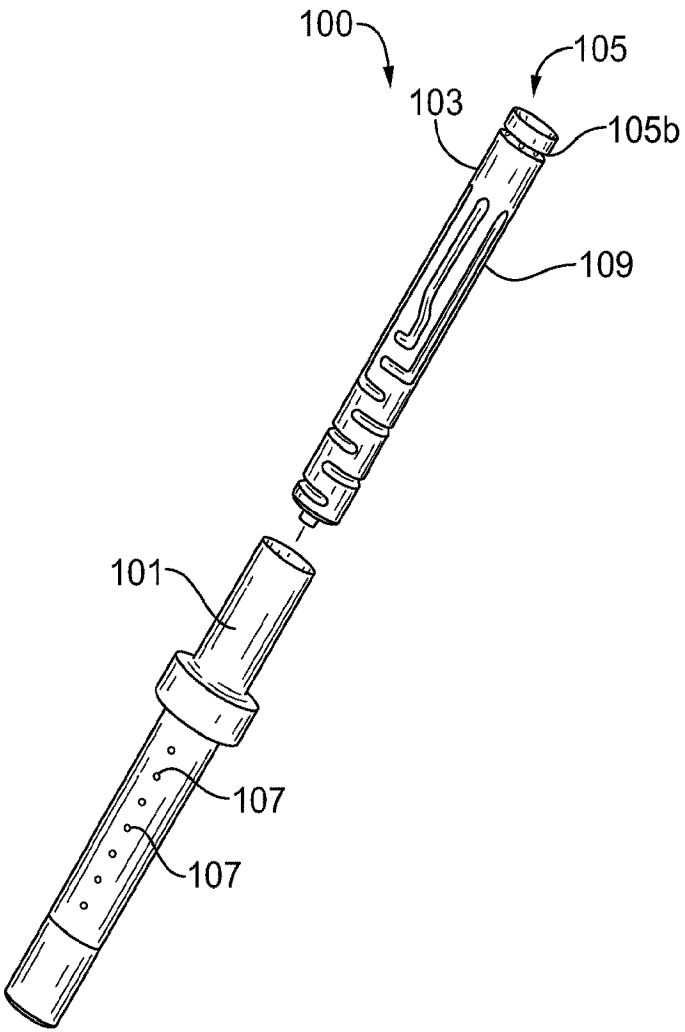
FIG. 4 is a front perspective exploded view of the flow distributor of FIG. 1A, showing the channel structure on the insert and the distributor holes on the sheath.
Figure 3:
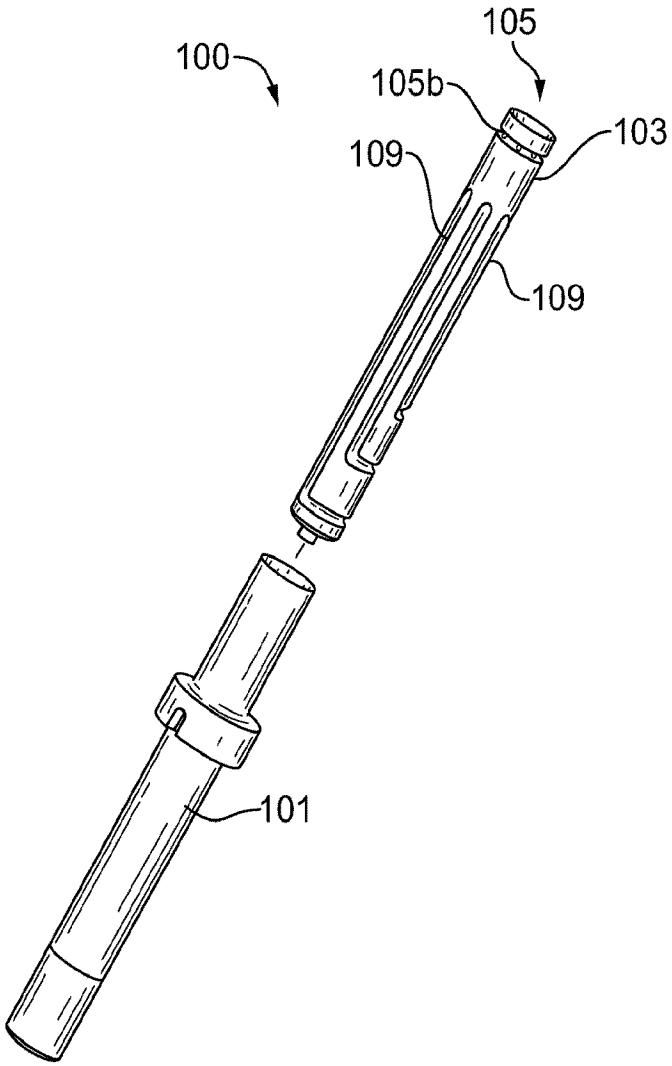
FIG. 3 is a rear perspective exploded view of the flow distributor of FIG. 1A, showing the channel structure on the insert.

Referring to FIGS. 3 and 4, the channels 109 can be fluidly isolated from each other such that each channel 109 does not mix with other channels 109 along the length of the channel 109. The fluid channels 109 can also be spaced apart circumferentially and/or otherwise dimensioned to balance the pressure drop therein such that each channel 109 experiences a predetermined pressure drop relative to the other channels 109 (e.g., the same across all channels 109). In some embodiments, each fluid channel can be defined to have equal total length and/or volume from the fluid inlet 105 to the distributor holes 107 to cause the pressure drop across each channel 109 to be equal. Alternatively, the fluid channels 109 can be unevenly spaced and/or differently sized to achieve a non-uniform pressure drop from hole to hole and/or non-equal flow of fluid out of each hole 107. For example, the channels 109 can be constructed and arranged such that a greater volume of fluid flows through one or more holes 107 as compared to the fluid flow through other holes 107.

Figure 6:
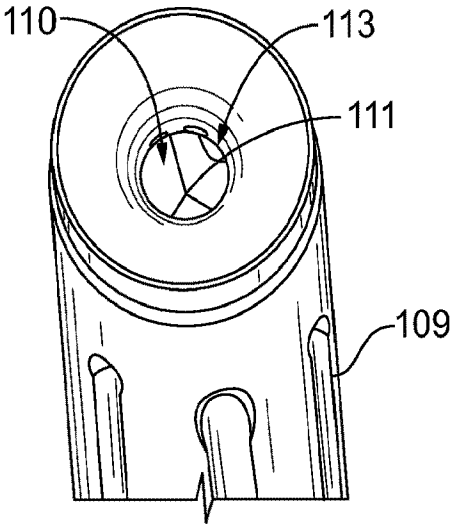
FIG. 6 is a perspective view of the inlet of FIG. 5, showing the inner inlet.

With reference to FIG. 5, the outer inlet 105*b* includes radial ports 106 that allow flow to join with flow in the inner inlet 105*a* at an inlet divider 111 (e.g, as shown in FIG. 6) such that flow that enters the inlet 105 is divided into different channels evenly. Uneven division of the fluid flow is also contemplated herein.

Figure 7:
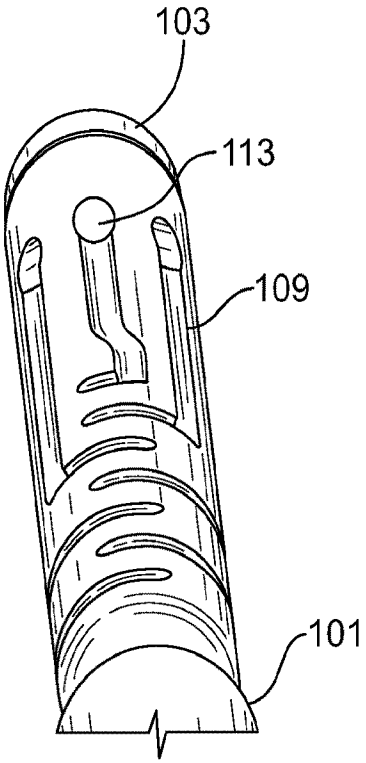
FIG. 7 is a perspective exploded view of a portion of the flow distributor of FIG. 1A, showing a channel fluidly communicating with the inlet.

As shown, the outer inlet 105*b* can, in some embodiments, define an annulus manifold or any other shape. Referring to FIG. 7, the insert 103 can further define a fluid channel port 113 for each fluid channel 109 in the insert to allow for the fluid to flow from the inlet 105 around the divider 111 and into each fluid channel 109. The fluid port 113 can be the upper portion of the fluid channel 109 that communicates with inlet 105 at the divider 111, or can have any other suitable design in the insert 103.

The inlet 105 can further define a throat 110 including a reducing portion such that an upstream end of the throat 110 has a larger diameter than the reducing portion. The inner inlet 105*a* and the outer inlet 105*b* can meet at the throat 110 such that the throat 110 allows flow from the outer inlet 105*b* and the inner inlet 105*a* to converge and mix above the divider 111. The outer inlet 105*b* can define a plurality of radial ports 106 leading to the throat 110. In some embodiments, each radial port 106 can align with a channel port 113 of the insert 103. While it is shown that there is a single outer inlet hole for each channel port 113, any suitable number of radial ports 106 and positioning thereof is contemplated.

It is also contemplated that the insert 103 and the sheath 101 can be manufactured as a single piece formed together any suitable method such that there is no distinct sheath 101 or insert 103, but the same or similar channels 109 are defined within the distributor device 100. Suitable methods include, but are not limited to, additive manufacturing and/or lost wax casting. Also, while the flow distributor 100 is shown as being two pieces, it can be fabricated of any suitable number of pieces.

In another aspect of this disclosure, a method includes forming a flow distributor 100 for a heat transfer device 201 having a plurality of channels. In some embodiments, the flow distributor device is formed as a single piece including a body defining a plurality of distributor holes 107, a plurality of fluid channels 109, and an inlet 105 as described above. Forming can be done in any suitable manner including, e.g., additive manufacturing, lost wax casting.

Referring again to FIG. 2, the flow distributor 100 can be inserted into a heat transfer device 201 such that the distributor holes 109 are in fluid communication with the heat transfer channel inlets 204 of each channel 205 of the heat transfer device 201. A nozzle 207 can be attached to the inlet 105 of the flow distributor 100 allowing coolant to pass therethrough.

Figure 8:
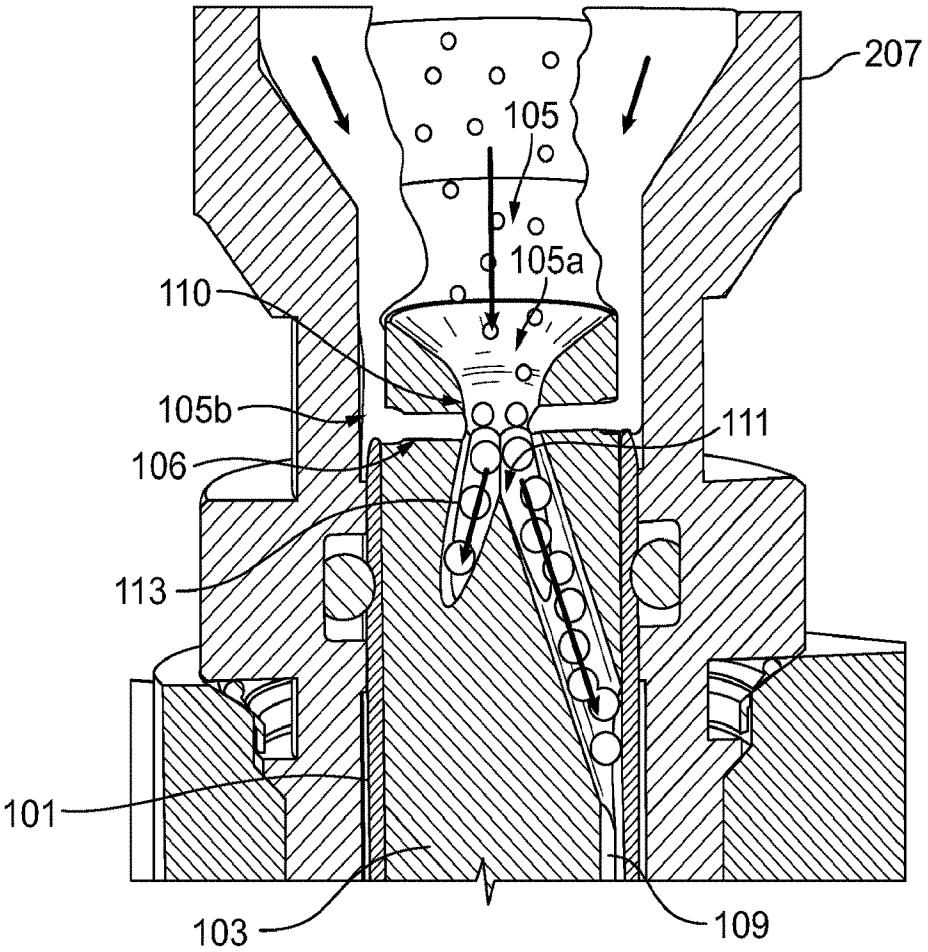
FIG. 8 is a cross-sectional perspective view of the flow distributor of FIG. 1A, schematically showing operation with a two-phase flow with the liquid traveling radially inward through the outer inlets.

As shown in FIG. 8, a fluid flow within a heat transfer system can transition to a two-phase flow including a liquid phase flowing along a radially outward portion of the nozzle 207 and a gas phase flowing inside that liquid phase. In such a case, the liquid phase will flow around the inlet 105 and into the outer inlet 105*b* to pass into the inlet 105 while the gas phase flows into the inner inlet 105*a* and mixes with the liquid phase within the inlet. This causes a roughly equal amount of each gas phase and liquid phase into each channel 109, out each hole 107, through its respective channel inlet 204 and thus into the heat transfer device 201. Due to the evenly distributed phases passing through each inlet 204, heat transfer is evened out in the heat transfer device 201 since each heat transfer channel 205 includes a similarly dense volume of cooling flow.

Figure 9:
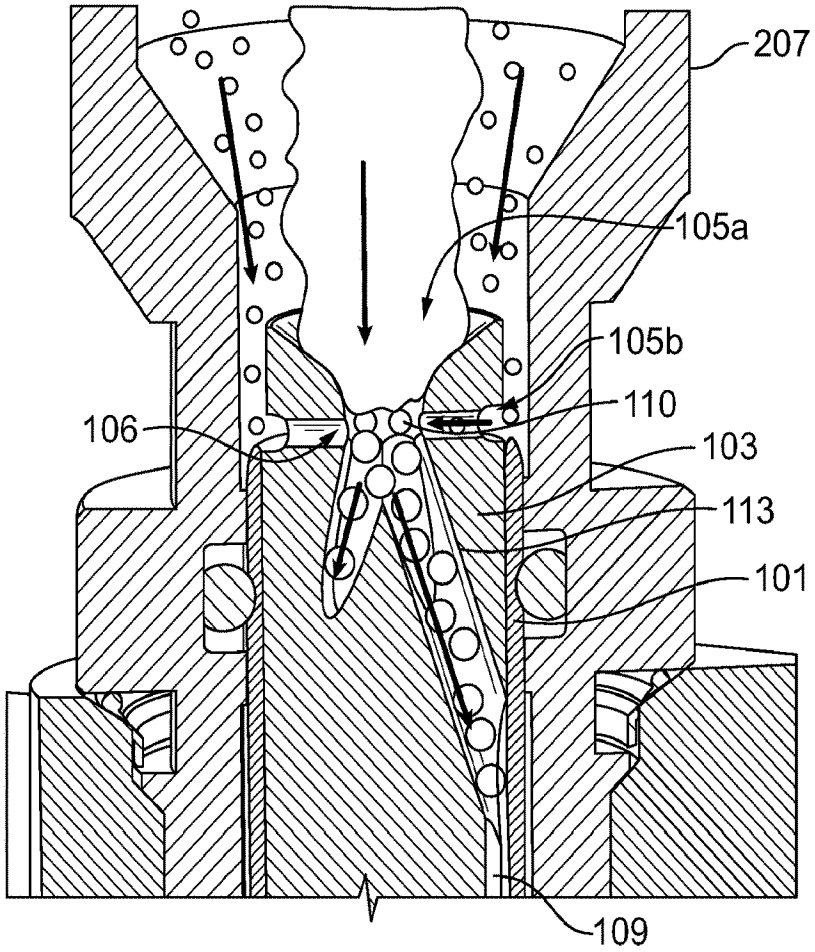
FIG. 9 is a cross-sectional perspective view of the flow distributor of FIG. 1A, schematically showing operation with a two-phase flow with the liquid traveling axially through the inner inlet.

As shown in FIG. 9, a fluid flow within a heat transfer system can transition to a two-phase flow including a gas phase flowing along a radially outward portion of the nozzle 207 and a liquid phase flowing radially inward of the gas phase. In such a case, the gas phase will flow around the inlet 105 and into the outer inlet 105*b* to pass into the inlet 105 while the liquid phase flows into the inner inlet 105*a* and mixes with the gas phase within the inlet 105. This causes a roughly equal amount of each phase to flow into each channel 109 and thus into the heat transfer device 201. Due to the evenly distributed phases, heat transfer is evened out in the heat transfer device 201 since each heat transfer channel 205 includes a similar density in its respective cooling flow.

This causes a roughly equal amount of gas phase and liquid phase into each channel 109, out each hole 107, through its respective channel inlet 204 and into the heat transfer device 201. Due to the evenly distributed phases passing through each inlet 204, heat transfer is evened out in the heat transfer device 201 since each heat transfer channel 205 includes a similar volume of cooling flow.

The methods and systems of the present disclosure, as described above and shown in the drawings, provide for a flow distribution device with superior properties including distributing multiple phase flow evenly, e.g., for a multi-channel heat transfer device. While the apparatus and methods of the subject disclosure have been shown and described with reference to embodiments, those skilled in the art will readily appreciate that changes and/or modifications may be made thereto without departing from the spirit and scope of the subject disclosure.

What is claimed is:

1. A flow distributor for a heat transfer device having a plurality of channels, comprising:

a sheath defining a plurality of distributor holes, each distributor hole configured to be in fluid communication with a respective channel inlet of each channel of the heat transfer device; and an insert defining a plurality of fluid channels therein and a fluid inlet, each fluid channel in fluid communication with the fluid inlet, wherein the insert is disposed within the sheath to seal the fluid channels, wherein each fluid channel is in fluid communication with a respective one of the distribution holes, wherein the fluid inlet includes an inner inlet and an outer inlet radially outward from the inner inlet for mixing a flow in the fluid inlet for evenly distributing the two phase flow into the fluid channels of the insert and into each channel of the heat transfer device, wherein the fluid inlet defines a throat having a reducing portion at a downstream end, and an inlet divider downstream of the reducing portion, wherein the outer inlet includes radial ports directing flow into the downstream reducing portion at the same axial location as an upstream end of the inlet divider.

2. The distributor of claim 1, wherein the sheath and the insert are integral.

3. The distributor of claim 2, wherein the insert is interference fit into the sheath.

4. The distributor of claim 1, wherein the channels are machined channels between the fluid inlet and the distributor holes.

5. The distributor of claim 4, wherein the channels are fluidly isolated from each other.

6. The distributor of claim 1, wherein the fluid channels are spaced apart circumferentially to balance the pressure drop therein.

7. The distributor of claim 1, wherein each fluid channel is defined to have equal pressure drop from the fluid inlet to the distributor holes.

8. The distributor of claim 1, wherein the fluid inlet further defining a fluid channel port for each fluid channel in the insert to allow for the fluid to flow from the inlet around the divider and into each fluid channel.

9. The distributor of claim 8, wherein the downstream reducing portion of the throat converges at the inlet divider and allows flow from the outer inlet and the inner inlet to mix above the inlet divider.

10. The distributor of claim 1, wherein the insert and the sheath are a single piece formed together using additive manufacturing.

11. The distributor of claim 1, wherein an upstream end of the throat has a larger diameter than the downstream reducing portion.

12. The distributor of claim 1, wherein the each radial port aligns with each of the plurality of fluid channels of the insert.

13. A method for flowing coolant into a heat transfer device, comprising the steps of:

forming a flow distributor for a heat transfer device having a plurality of channels, the flow distributor device comprising:

a body defining a plurality of distributor holes, each distributor hole configured to be in fluid communication with a respective channel inlet of each channel of the heat transfer device, wherein the body defines a plurality of fluid channels therein and a fluid inlet, each fluid channel in fluid communication with the fluid inlet, wherein each fluid channel is in fluid communication with a respective one of the distribution holes, wherein the fluid inlet includes an inner inlet and an outer inlet radially outward from the inner inlet for mixing a two phase flow in the fluid inlet for evenly distributing the two phase flow into the fluid channels defined in the body and into each channel of the heat transfer device, wherein the fluid inlet defines a throat having a reducing portion at a downstream end, and an inlet divider downstream of the reducing portion, wherein the outer inlet includes radial ports directing flow into the downstream reducing portion at the same axial location as an upstream end of the inlet divider.

14. The method of claim 13, wherein forming includes additive manufacturing.

15. A flow director for fluid, comprising:

a cylindrical flow body extending along a body axis, the body having internal and external body walls, and a plurality of outlets along the axis extending radially through said walls;

a cylindrical sheath coaxial with the flow body, the sheath having a sheath body defined by internal and external sheath walls and a plurality of passages extending axially along the external wall, wherein the external sheath wall is adjacent the internal flow body wall, and each passage in the sheath wall is in fluid communication with a respective outlet in the flow body wall; and a flow director inlet configured to deliver fluid to each passage in the sheath wall, wherein the flow director inlet includes an inner inlet and an outer inlet radially outward from the inner inlet for mixing a two phase flow in the fluid inlet for evenly distributing the two phase flow into the plurality of passages defined in the cylindrical sheath and into each channel of a heat transfer device, wherein the fluid inlet defines a throat having a reducing portion at a downstream end, and an inlet divider downstream of the reducing portion, wherein the outer inlet includes radial ports directing flow into the downstream reducing portion at the same axial location as an upstream end of the inlet divider.

16. The flow director of claim 15, wherein the sheath wall includes a first and second passage, and the axial length of the first passage is greater than the axial length of the second passage.

* * * * *